US011318596B2

(12) United States Patent
Yoshikane et al.

(10) Patent No.: US 11,318,596 B2
(45) Date of Patent: May 3, 2022

(54) POWER TOOL HAVING HAMMER MECHANISM

(71) Applicant: MAKITA CORPORATION, Anjo (JP)

(72) Inventors: Kiyonobu Yoshikane, Anjo (JP); Yusuke Takano, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/072,444

(22) Filed: Oct. 16, 2020

(65) Prior Publication Data

US 2021/0114193 A1 Apr. 22, 2021

(30) Foreign Application Priority Data

Oct. 21, 2019 (JP) ..... JP2019-192325
Oct. 21, 2019 (JP) ..... JP2019-192326
(Continued)

(51) Int. Cl.
*B25D 11/06* (2006.01)
*B25D 11/10* (2006.01)
(Continued)

(52) U.S. Cl.
CPC ..... *B25D 16/006* (2013.01); *B25D 11/062* (2013.01); *B25D 11/10* (2013.01);
(Continued)

(58) Field of Classification Search
CPC ..... B25D 11/062; B25D 11/10; B25D 11/102; B25D 16/003; B25D 16/006; B25D 17/24;
(Continued)

(56) References Cited

U.S. PATENT DOCUMENTS 4,158,313 A * 6/1979 Smith ..... B23B 31/1207 173/47
4,280,359 A 7/1981 Schmid et al.
(Continued)

FOREIGN PATENT DOCUMENTS

BE 779394 A 5/1972
DE 3241863 A1 5/1984
(Continued)

OTHER PUBLICATIONS

Unpublished U.S. Appl. No. 17/072,462.
(Continued)

*Primary Examiner* — Thanh K Truong
*Assistant Examiner* — David G Shutty
(74) *Attorney, Agent, or Firm* — J-Tek Law PLLC; Jeffrey D. Tekanic; Scott T. Wakeman

(57) ABSTRACT

A power tool includes a motor having a motor shaft, a first intermediate shaft, and a second intermediate shaft extending in parallel to the first intermediate shaft. An output shaft removably holds a tool accessory and has a driving axis extending in parallel to the first and second intermediate shafts. A motion-converting mechanism converts rotation of the first intermediate shaft to linearly hammer the tool accessory. A rotation-transmitting mechanism transmits rotation of the second intermediate shaft to rotate the output shaft. A rotational axis of the motor shaft intersects, or is skewed relative to, the driving axis. A pair of first gears, e.g., bevel gears, operably couples the motor shaft to a first one of the first and second intermediate shafts. A pair of second gears operably couples the first one of the first and second intermediate shafts to a second one of the first and second intermediate shafts.

20 Claims, 8 Drawing Sheets

(30) Foreign Application Priority Data

Oct. 21, 2019 (JP) ..... JP2019-192327
Oct. 21, 2019 (JP) ..... JP2019-192328

(51) Int. Cl.
*B25D 16/00* (2006.01)
*B25D 17/24* (2006.01)

(52) U.S. Cl.
CPC ..... *B25D 11/102* (2013.01); *B25D 16/003* (2013.01); *B25D 17/24* (2013.01); *B25D 2211/062* (2013.01); *B25D 2216/0015* (2013.01); *B25D 2216/0038* (2013.01); *B25D 2217/0073* (2013.01)

(58) Field of Classification Search
CPC ..... B25D 2211/062; B25D 2216/0015; B25D 2216/0038; B25D 2017/0073
See application file for complete search history.

(56) References Cited

U.S. PATENT DOCUMENTS

| | | | | |
|---|---|---|---|---|
| 4,325,436 | A | 4/1982 | Richter et al. | |
| 4,712,625 | A * | 12/1987 | Kress | B25D 16/00 173/104 |
| 5,036,925 | A | 8/1991 | Wache | |
| 5,901,817 | A * | 5/1999 | Gitnes | F16D 63/006 188/134 |
| 6,192,996 | B1 | 2/2001 | Sakaguchi et al. | |
| 6,286,217 | B1 | 9/2001 | Dassoulas et al. | |
| 6,460,627 | B1 | 10/2002 | Below et al. | |
| 6,666,284 | B2 | 12/2003 | Stirm | |
| 6,732,815 | B2 | 5/2004 | Hanke et al. | |
| 7,021,401 | B2 | 4/2006 | Droste et al. | |
| 7,707,729 | B2 | 5/2010 | Moreno | |
| 8,281,873 | B2 | 10/2012 | Ullrich et al. | |
| 8,292,002 | B2 | 10/2012 | Baumann et al. | |
| 8,403,075 | B2 | 3/2013 | Schlesak et al. | |
| 8,464,805 | B2 | 6/2013 | Baumann et al. | |
| 8,490,715 | B2 * | 7/2013 | Engelfried | B25D 11/062 173/109 |
| 9,010,235 | B2 | 4/2015 | Drevet | |
| 9,321,163 | B2 | 4/2016 | Onoda et al. | |
| 9,833,850 | B2 | 12/2017 | Schmid | |
| 10,272,506 | B2 | 4/2019 | Doumani et al. | |
| 11,052,525 | B2 * | 7/2021 | Furusawa | B25D 16/006 |
| 2004/0108123 | A1 | 6/2004 | Shibata et al. | |
| 2009/0145618 | A1 | 6/2009 | Duesselberg et al. | |
| 2010/0270045 | A1 | 10/2010 | Ullrich | |
| 2014/0000923 | A1 * | 1/2014 | Dietel | B25D 11/06 173/47 |
| 2015/0158169 | A1 * | 6/2015 | Lauterwald | B25D 11/00 173/48 |
| 2017/0106517 | A1 | 4/2017 | Machida | |
| 2017/0320206 | A1 | 11/2017 | Machida et al. | |
| 2021/0114194 | A1 | 4/2021 | Machida et al. | |
| 2021/0114195 | A1 * | 4/2021 | Yoshikane | B25D 11/102 |

FOREIGN PATENT DOCUMENTS

| | | | | |
|---|---|---|---|---|
| EP | 2700477 | A1 | 2/2014 | |
| EP | 2883661 | A1 | 6/2015 | |
| EP | 2700477 | B1 | 12/2017 | |
| EP | 3456479 | A1 | 3/2019 | |
| EP | 3461594 | A1 * | 4/2019 | B25D 16/006 |
| EP | 3456479 | B1 | 2/2020 | |
| GB | 2160810 | A * | 1/1986 | B25D 16/00 |
| GB | 2160810 | A | 1/1986 | |
| JP | 4195228 | B2 | 12/2008 | |
| JP | 2016000447 | A | 1/2016 | |
| WO | 2016076377 | A1 | 5/2016 | |

OTHER PUBLICATIONS

Unpublished U.S. Appl. No. 17/072,484.
Extended European Search Report from the European Patent Office dated Mar. 16, 2021 in related application No. EP 20 20 2562.3, including European Search Opinion, European Search Report and examined claims 1-14.
Extended European Search Report from the European Patent Office dated Mar. 16, 2021 in related application No. EP 20 20 2569.8, including European Search Opinion, European Search Report and examined claims 1-15.
Office Action dated Feb. 2, 2022, in related U.S. Appl. No. 17/072,484.

* cited by examiner

POWER TOOL HAVING HAMMER MECHANISM

CROSS-REFERENCE TO RELATED APPLICATION

The present application claims priority to Japanese patent application nos. 2019-192325, 2019-192326, 2019-192327, and 2019-192328, all of which were filed on Oct. 21, 2019 and the contents of all of which are hereby fully incorporated herein by reference.

TECHNICAL FIELD

The present disclosure generally relates to power tools having a hammer mechanism, such as a rotary hammer or a hammer drill, which are configured to linearly reciprocally drive (axially hammer) a tool accessory to perform a hammering operation and to rotationally drive the tool accessory to perform a drilling operation.

BACKGROUND

A rotary hammer is configured to linearly drive a tool accessory coupled to a tool holder along a driving axis to perform a hammering operation. The rotary hammer is also configured to rotationally drive the tool accessory around the driving axis to perform a drilling operation. In typical known rotary hammers, a motion-converting mechanism for converting rotation of an intermediate shaft into linear motion is employed to perform the hammering operation, and a rotation-transmitting mechanism for transmitting rotation to the tool holder via the intermediate shaft is employed to perform the drilling operation.

SUMMARY

In one aspect of the present teachings, a power tool, such as a rotary hammer or hammer drill, includes a final output shaft configured to removably hold a tool accessory and to be rotatable around a driving axis. A motor has a motor shaft extends in a direction intersecting the driving axis. A first intermediate shaft extends in parallel to the driving axis and a first driving mechanism is configured to convert rotation of the first intermediate shaft into linear reciprocating motion to hammer the tool accessory along the driving axis. A second intermediate shaft extends in parallel to the driving axis and a second driving mechanism is configured to transmit rotation of the second intermediate shaft to the final output shaft to rotationally drive the tool accessory around the driving axis. The motor shaft is configured to rotate a first one of the first intermediate shaft and the second intermediate shaft via a pair of bevel gears, and the first one of the first intermediate shaft and the second intermediate shaft is configured to rotate a second one of the first intermediate shaft and the second intermediate shaft via a pair of gears.

In such a design, because the power transmission path for the hammering operation can be placed in parallel to the power transmission path for the drilling operation, a more compact power tool in the front-rear direction can be achieved, thereby enabling the power tool to be conveniently and effectively utilized in a wider range of processing operations.

Additional objects, aspects, embodiments and advantages of the present teachings will be readily understandable to a person of ordinary skill in the art upon reading the following detailed description of embodiments of the present teachings in view of the appended drawings and claims.

DETAILED DESCRIPTION OF THE EMBODIMENTS

An embodiment is now described with reference to the drawings. In this embodiment, a rotary hammer 101 is described as an example of a power tool having a hammering mechanism. The rotary hammer 101 is a hand-held power tool that may be used for processing operations such as chipping and drilling. The rotary hammer 101 is capable of performing the operation (hereinafter referred to as a hammering operation) of linearly driving a tool accessory 91 along a specified driving axis A1. The rotary hammer 101 is also capable of performing the operation (hereinafter referred to as a drilling operation) of rotationally driving the tool accessory 91 around the driving axis A1.

Figure 1:
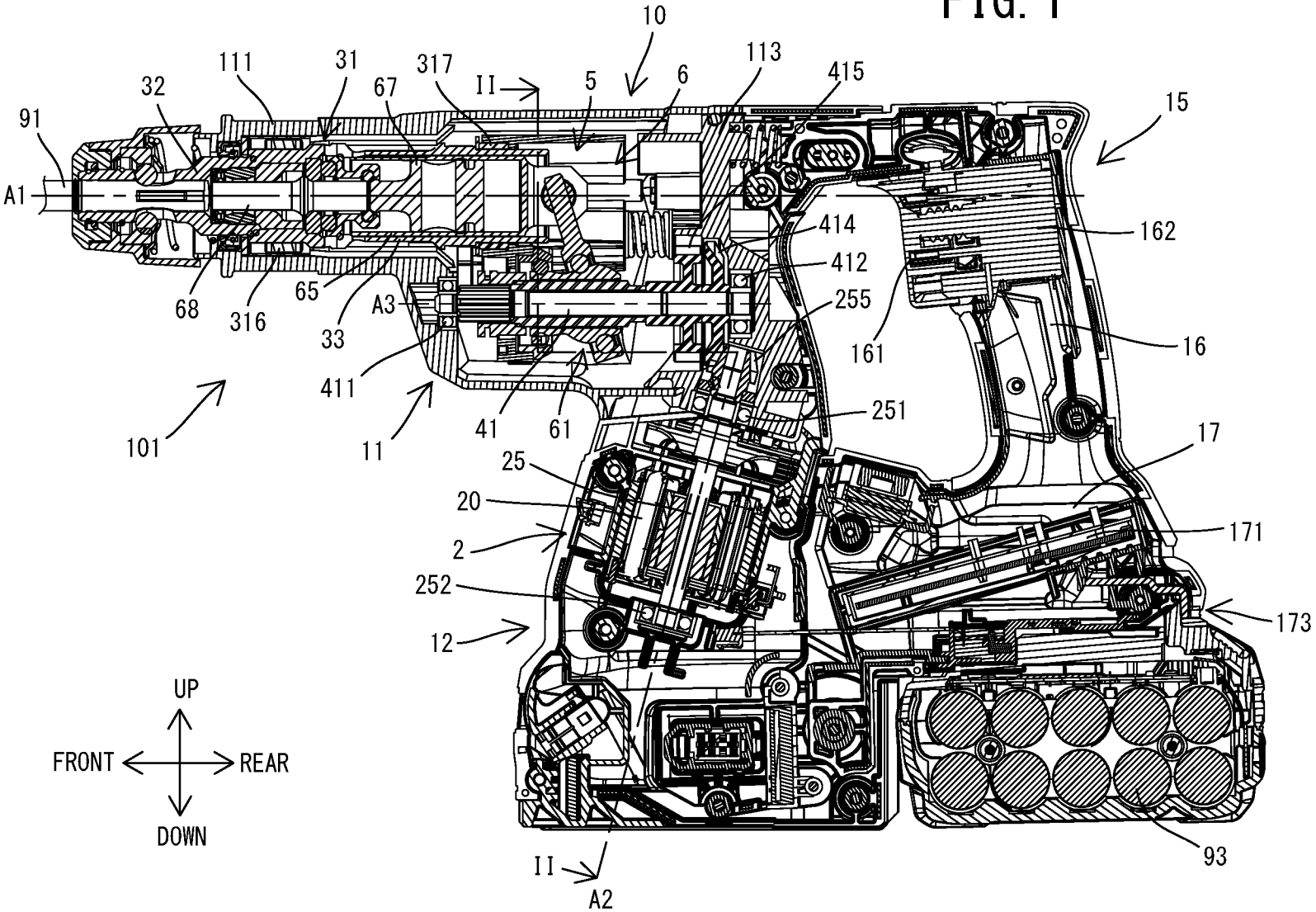
FIG. 1 is a sectional view of a rotary hammer.

First, the general structure of the rotary hammer 101 is described with reference to FIG. 1. As shown in FIG. 1, an outer shell of the rotary hammer 101 is mainly formed by a body housing 10 and a handle 15 connected to the body housing 10.

The body housing 10 is a hollow body, which may also be referred to as a tool body or an outer shell housing. The body housing 10 houses a spindle 31, a driving mechanism 5 and a motor 2. The spindle 31 is an elongate circular cylindrical member. An axial end portion of the spindle 31 includes a tool holder 32. The tool holder 32 is configured to removably hold the tool accessory 91. A longitudinal axis of the spindle 31 defines a driving axis A1 of the tool accessory 91. In this embodiment, the body housing 10 as a whole is generally L-shaped in a side view. The body housing 10 includes a driving-mechanism-housing part 11 that houses the spindle 31 and the driving mechanism 5, and a motor-housing part 12 that houses the motor 2. The driving-mechanism-housing part 11 extends along the driving axis A1. The tool holder 32 is disposed within one end portion of the driving-mechanism-housing part 11 in an extension direction of the driving axis A1 (hereinafter simply referred to as a driving-axis direction). The motor-housing part 12 protrudes obliquely from the other end portion of the driving-mechanism-housing part 11 in the driving-axis direction, in a direction away from the driving axis A1. The motor 2 is disposed within the motor-housing part 12 such that a rotation axis A2 of a motor shaft 25 extends in a direction intersecting the driving axis A1 (specifically, obliquely to the driving axis A1).

In the following description, for convenience sake, the extension direction of the driving axis A1 is defined as a front-rear direction of the rotary hammer 101. In the front-rear direction, the side of one end portion of the rotary hammer 101, within which the tool holder 32 is disposed, is defined as the front of the rotary hammer 101 and the opposite side is defined as the rear of the rotary hammer 101. A direction that is orthogonal to the driving axis A1 and that generally (substantially) corresponds to the extension direction of the rotation axis A2 of the motor shaft 25 is defined as an up-down direction of the rotary hammer 101. In the up-down direction, the direction which the motor-housing part 12 protrudes away from the driving-mechanism-housing part 11 is defined as a downward direction, and the opposite direction is defined as an upward direction. Further, a direction that is orthogonal to both the front-rear direction and the up-down direction is defined as a left-right direction.

The handle 15 as a whole is generally C-shaped in a side view. Both end portions of the handle 15 are connected to the body housing 10 to form a loop-shaped handle portion overall. The handle 15 includes an elongate cylindrical grip part 16 and a rectangular box-like controller-housing part 17. The grip part 16 is a portion configured to be held by a user. The grip part 16 is spaced apart rearward from the body housing 10 and extends generally in the up-down direction, intersecting the driving axis A1. A trigger 161 is provided in (at) a front upper end portion of the grip part 16. The trigger 161 is configured to be depressed by a user. A switch 162 is disposed within the grip part 16. The switch 162 is turned ON in response to a manual depressing of the trigger 161. The controller-housing part 17 houses a controller 171 for controlling driving of the motor 2. A battery-mounting part 173 is provided in a lower end portion of the controller-housing part 17. A rechargeable battery (battery pack) 93 may be removably mounted thereto as a power source of the motor 2, the controller 171, etc.

In this embodiment, the handle 15 is connected to the body housing 10 so as to be elastically movable relative to the body housing 10. Specifically, a lower end portion of the handle 15 is disposed within a lower end portion of the motor-housing part 12 and supported to be pivotable around a pivot axis extending in the left-right direction. Further, an upper end portion of the handle 15 is connected to a rear end portion of the driving-mechanism-housing part 11 via a biasing spring so as to be movable in the front-rear direction relative to the rear end portion.

In the rotary hammer 101, when the trigger 161 is depressed and the switch 162 is turned ON, the motor 2 is energized by the controller 171, so that the hammering operation and/or the drilling operation is performed.

The detailed structure of the rotary hammer 101 is now described.

First, the structure of the body housing 10 (the motor-housing part 12 and the driving-mechanism-housing part 11) and its internal structures are described.

As shown in FIG. 1, the motor-housing part 12 is a portion of the body housing 10 that extends downward from the rear end portion of the driving-mechanism-housing part 11. The motor-housing part 12 houses the motor 2. In this embodiment, a DC brushless motor is employed as the motor 2. The motor 2 has a body 20 including a stator and a rotor, and a motor shaft 25 configured to rotate together with the rotor. The motor shaft 25 is supported by bearings 251 and 252 so as to be rotatable around the rotation axis A2 relative to the body housing 10. The rotation axis A2 extends obliquely downward and forward relative to the driving axis A1. An upper end portion of the motor shaft 25 protrudes into the driving-mechanism-housing part 11. A driving bevel gear 255 is fixed to the upper end portion of the motor shaft 25.

As shown in FIG. 1, the driving-mechanism-housing part 11 is a portion of the body housing 10 that extends along the driving axis A1 and houses the spindle 31 and the driving mechanism 5. The driving-mechanism-housing part 11 has a circular cylindrical front end portion, which is referred to as a barrel part 111. A portion of the driving-mechanism-housing part 11 other than the barrel part 111 has a generally rectangular box-like shape. The barrel part 111 is configured such that an auxiliary handle (not shown) is removably attachable thereto. A user can hold both the handle 15 and the auxiliary handle attached to the barrel part 111 at the same time.

The spindle 31 is a final output shaft of the rotary hammer 101. The spindle 31 is supported by bearings 316 and 317 so as to be rotatable around the driving axis A1 relative to the body housing 10. A front half of the spindle 31 forms the tool holder 32, to which the tool accessory 91 is removably attachable. The tool accessory 91 is inserted into the tool holder 32, such that a longitudinal axis of the tool accessory 91 coincides with the driving axis A1. The tool accessory 91 is movable relative to the tool holder 32 in a direction of the longitudinal axis of the tool holder 32, while its rotation relative to the tool holder 32 is restricted (i.e. the tool accessory 91 rotates together with the tool holder 32). A rear half of the spindle 31 forms a cylinder 33 that slidably holds a piston 65, which will be described below. In this embodiment, the spindle 31 is a single (integral) member including the tool holder 32 and the cylinder 33. The spindle 31, however, may be formed by connecting a plurality of members.

The driving mechanism 5 includes a striking mechanism 6 configured to perform the hammering operation, and a rotation-transmitting mechanism 7 (see FIG. 3) configured to perform the drilling operation. In this embodiment, power of (from) the motor 2 is transmitted to the striking mechanism 6 via the first intermediate shaft 41. Power of (from) the motor 2 is also transmitted to the rotation-transmitting mechanism 7 via the second intermediate shaft 42. Thus, the rotary hammer 101 has two separate intermediate shafts for the striking mechanism 6 and the rotation-transmitting mechanism 7, respectively.

The arrangement of the first intermediate shaft 41 and the second intermediate shaft 42 is now described.

Figure 2:
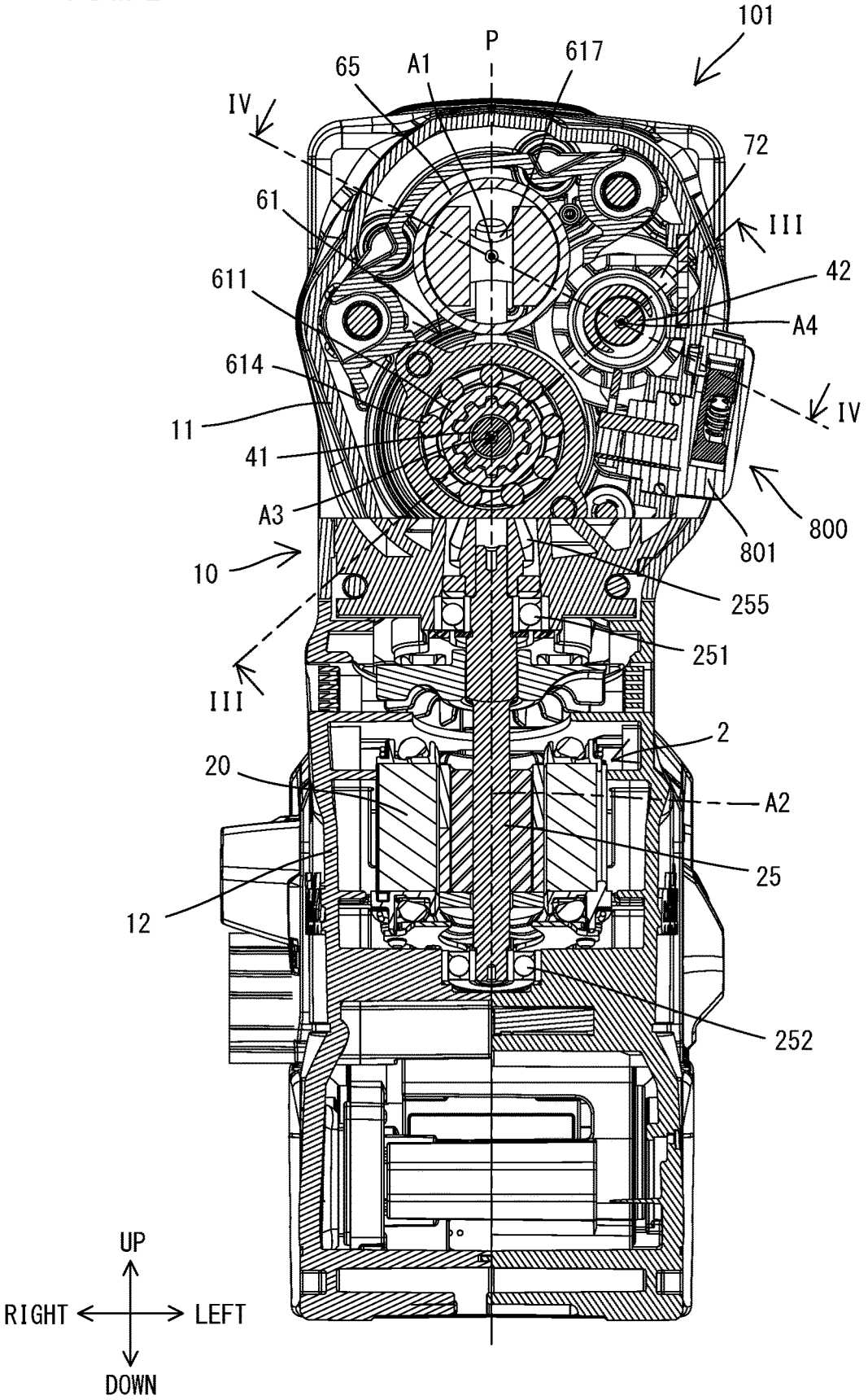
FIG. 2 is a sectional view taken along line II-II in FIG. 1.
Figure 3:
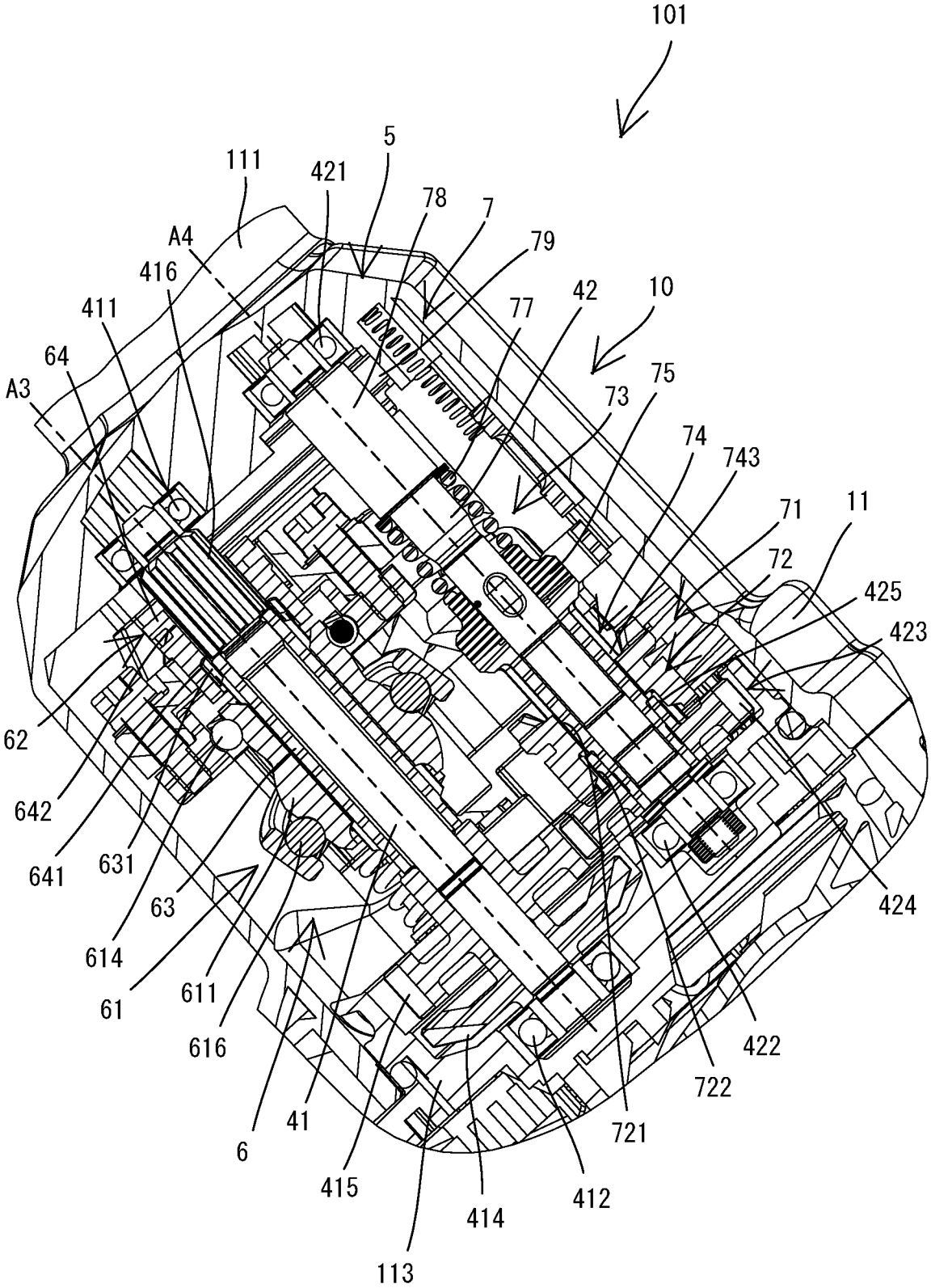
FIG. 3 is a sectional view taken along line in FIG. 2.

As shown in FIGS. 1 to 4, the first intermediate shaft 41 and the second intermediate shaft 42 extend within the driving-mechanism-housing part 11 in parallel to the driving axis A1. As shown in FIG. 3, the first intermediate shaft 41 is supported via two bearings 411 and 412 so as to be rotatable around a rotation axis A3 relative to the body housing 10. Similarly, the second intermediate shaft 42 is supported via two bearings 421 and 422 so as to be rotatable around a rotation axis A4 relative to the body housing 10.

As shown in FIG. 2, in this embodiment, the rotation axis A3 of the first intermediate shaft 41 extends directly below the driving axis A1 in parallel to the driving axis A1. Further, the rotation axis A3, the driving axis A1 and the rotation axis A2 of the motor shaft 25 all extend in (coincide with) the same (common) plane (hereinafter referred to as a reference plane P). The reference plane P extends in the up-down direction of the rotary hammer 101 (and also in the front-rear direction). The rotation axis A4 of the second intermediate shaft 42 is located on the left side of the reference plane P.

Figure 5:
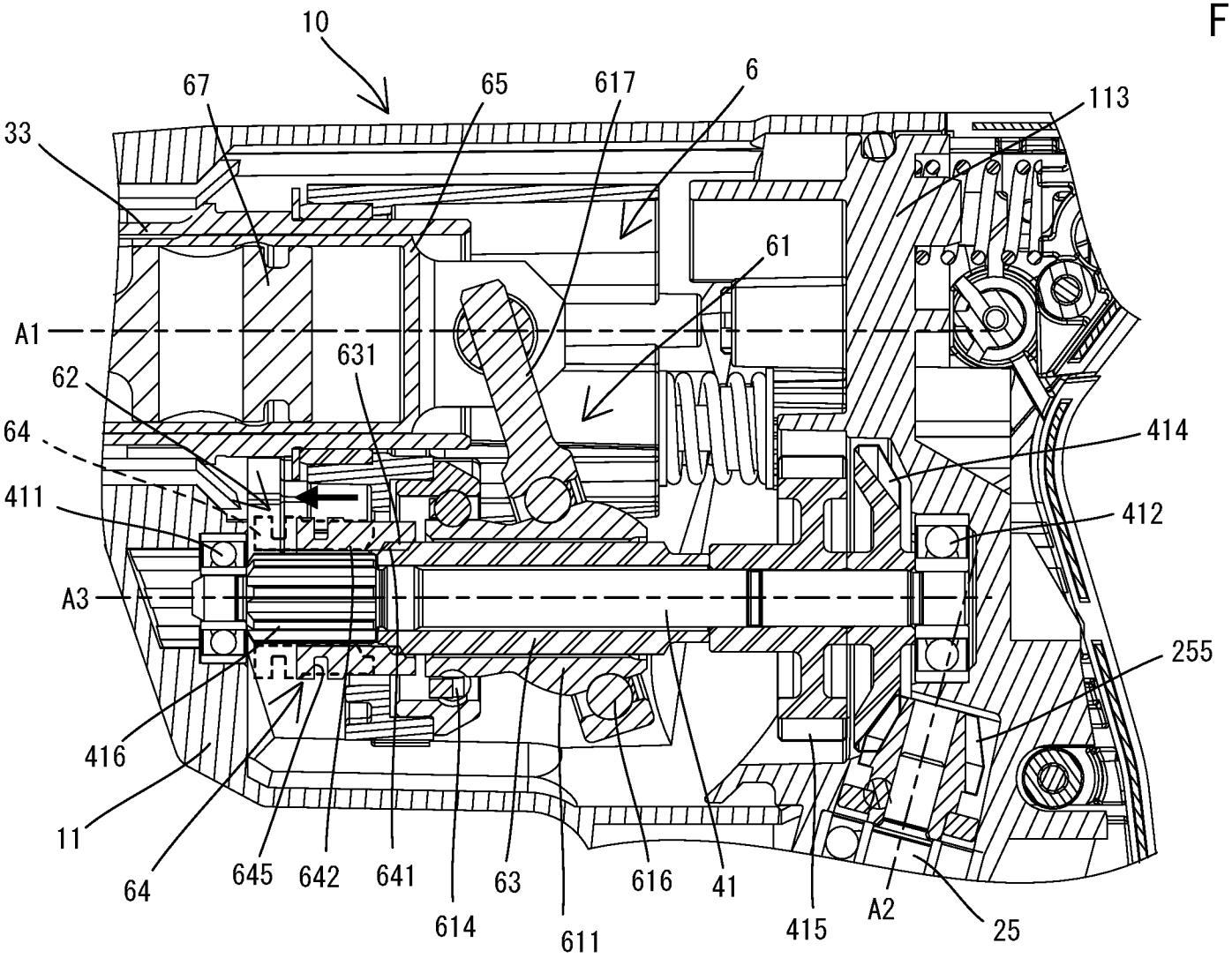
FIG. 5 is a partial, enlarged view of FIG. 1.

As shown in FIGS. 3 and 5, a driven bevel gear 414 is fixed to a rear end portion of the first intermediate shaft 41, adjacent to the front of the bearing 412. The driven bevel gear 414 meshes with the driving bevel gear 255 of the motor shaft 25. Thus, rotation of the motor shaft 25 is transmitted to the first intermediate shaft 41 via the driving bevel gear 255 and the driven bevel gear 414.

In this embodiment, the rotation axis A3 of the first intermediate shaft 41 and the rotation axis A2 of the motor shaft 25 both extend in (coincide with) the reference plane P and intersect each other. More specifically, the rotation axis A2 and the rotation axis A3 intersect with each other so as to form an acute angle therebetween. Therefore, in this embodiment, straight bevel gears, which are simple in structure and relatively cheap, are employed as the driving bevel gear 255 and the driven bevel gear 414. The driving bevel gear 255 and the driven bevel gear 414, however, may be a pair of a different kind of gears with intersecting axes (e.g. a pair of spiral bevel gears). The driving bevel gear 255 and the driven bevel gear 414 form a speed-reducing (torque-increasing) gear mechanism.

Further, as shown in FIG. 3, a driving gear 415 is fixed to the rear end portion of the first intermediate shaft 41, adjacent to the front of the driven bevel gear 414. A gear member 423 having a driven gear 424 is disposed on a rear end portion of the second intermediate shaft 42, adjacent to the front of the bearing 422. The driven gear 424 meshes with the driving gear 415. Thus, rotation of the first intermediate shaft 41 is transmitted to the gear member 423 via the driving gear 415 and the driven gear 424. In this embodiment, the driving gear 415 and the driven gear 424 have the same diameter. Further, spur gears, which are simple in structure and relatively cheap, are employed as the driving gear 415 and the driven gear 424. The driving gear 415 and the driven gear 424, however, may be a pair of a different kind of gears having parallel axes (e.g. a pair of helical gears).

The gear member 423 has a circular cylindrical shape. The gear member 423 is disposed on the outer peripheral side of the second intermediate shaft 42 (specifically, on the outer peripheral side of a drive-side member 74). A spline part 425 is provided on an outer periphery of a cylindrical front end portion of the gear member 423. The spline part 425 includes a plurality of splines (external teeth) extending in a direction of the rotation axis A4 (i.e. front-rear direction). Rotation of the gear member 423 is transmitted to the second intermediate shaft 42 via a second transmitting member 72 and a torque limiter 73, which will be described in detail below.

The detailed structures of the striking mechanism 6 and the rotation-transmitting mechanism 7 are now described in this order.

The striking mechanism 6 is a mechanism for performing the hammering operation, and is configured to convert rotation of the first intermediate shaft 41 into linear reciprocating motion and linearly (reciprocally) drive the tool accessory 91 along the driving axis A1. In this embodiment, as shown in FIGS. 1 and 5, the striking mechanism 6 includes a motion-converting member (mechanism) 61, a piston 65, a striker 67 and an impact bolt 68.

The motion-converting member 61 is disposed on (around) the first intermediate shaft 41. The motion-converting member 61 is configured to convert rotation of the first intermediate shaft 41 into linear reciprocating motion and transmit it to the piston 65. More specifically, the motion-converting member 61 includes a rotary body 611 and an oscillating member 616.

The rotary body 611 is supported by a bearing 614 so as to be rotatable around the rotation axis A3 relative to the body housing 10. In this embodiment, a circular cylindrical intervening member 63 is disposed between the rotary body 611 and the first intermediate shaft 41. The intervening member 63 is configured to be immovable in the front-rear direction relative to the first intermediate shaft 41, while being selectively rotatable relative to the first intermediate shaft 41 together with the rotary body 611. A front end portion of the intervening member 63 protrudes forward from a front end of the rotary body 611. The oscillating member 616 is mounted on (around) the rotary body 611, and configured to oscillate (pivot or rock back-and-forth) in an extension direction of the rotation axis A3 (i.e. front-rear direction) while the rotary body 611 is rotating. To achieve this oscillating (linear reciprocating) motion, a plurality of rolling elements (e.g., balls) is disposed on (in) an elliptical track defined by an outer surface of the roller body 611 (which acts as an inner ring of a roller bearing) and an inner surface of the oscillating member 616 (which acts as an outer ring of the roller bearing), whereby rotation of the roller body 611 (inner ring) causes the oscillating member 616 (outer ring) to reciprocally pivot within a predetermined angular range about a horizontal line that intersects and is perpendicular to the rotational axis of the first intermediate shaft 41. The oscillating member 616 has an arm part 617 extending upward away from the rotary body 611, which arm 617 moves back and forth in a direction parallel to the rotational axis of the first intermediate shaft 41 while the rotary body 611 is rotating, owing to the connection of the arm 617 to the piston 65. The oscillating member 616 may alternatively be called a rocking member or a pivoting member and refers to a structure having a function of oscillating or pivoting within a predetermined angular range about a line intersecting the rotational axis of the first intermediate shaft 41. It is noted that the motion-converting member/mechanism (also known as a rotation-to-linear reciprocating motion converting mechanism) 61 may be implemented as a swash bearing in the present embodiment, or in alternate embodiments, with a barrel cam follower, a wobble plate assembly, etc.

The piston 65 is a bottomed circular cylindrical member. The piston 65 is disposed within the cylinder 33 of the spindle 31 so as to be slidable along the driving axis A1. The piston 65 is connected to the arm part 617 of the oscillating member 616 via a connecting pin and reciprocally moves in the front-rear direction while the oscillating member 616 is oscillating (pivoting or rocking back-and-forth in the front-rear direction).

The striker 67 is a striking element for applying a striking force to the tool accessory 91. The striker 67 is disposed within the piston 65 so as to be slidable along the driving axis A1. An internal space of the piston 65 behind the striker 67 is defined as an air chamber that serves as an air spring. The impact bolt 68 is an intermediate element for transmitting kinetic energy of the striker 67 to the tool accessory 91. The impact bolt 68 is disposed within the tool holder 32 in front of the striker 67 so as to be movable along the driving axis A1.

When the piston 65 is reciprocally moved in the front-rear direction along with (in response to) oscillating movement of the oscillating member 616, the air pressure within the air chamber fluctuates and the striker 67 slides in the front-rear direction within the piston 65 by the action of the air spring. More specifically, when the piston 65 is moved forward, the air within the air chamber is compressed and its internal pressure increases. Thus, the striker 67 is pushed forward at high speed by the action of the air spring and strikes the impact bolt 68. The impact bolt 68 transmits the kinetic energy of the striker 67 to the tool accessory 91. Thus, the tool accessory 91 is linearly driven along the driving axis A1. On the other hand, when the piston 65 is moved rearward, the air within the air chamber expands and its internal pressure decreases, so that the striker 67 moves rearward. The tool accessory 91 moves rearward together with the impact bolt 68 by being pressed against a workpiece. In this manner, the striking mechanism 6 repetitively performs the hammering operation.

In this embodiment, rotation of the first intermediate shaft 41 is transmitted to the motion-converting member 61 (specifically, the rotary body 611) via a first transmitting member 64 and the intervening member 63.

The first transmitting member 64 is disposed on (around) the first intermediate shaft 41 in a co-axial manner. The first transmitting member 64 is configured to be rotatable together with the first intermediate shaft 41. The first transmitting member 64 is also configured to be movable in the direction of the rotation axis A3 (i.e. front-rear direction) relative to the first intermediate shaft 41 and the intervening member 63. More specifically, a first spline part 641, which is selectively engageable with the intervening member 63, and a second spline part 642, which is always engaged with the spline part 416 of the first intermediate shaft 41, are provided on an inner periphery of the first transmitting member 64.

The first spline part 641 is provided on an inner periphery of a rear end portion of the first transmitting member 64. The first spline part 641 includes a plurality of splines (internal teeth) extending in the direction of the rotation axis A3 (i.e. front-rear direction). Correspondingly, a spline part 631 is provided on an outer periphery of the front end portion of the intervening member 63. The spline part 631 includes a plurality of splines (external teeth) configured to be selectively engaged (meshed) with the first spline part 641.

The second spline part 642 is provided on an inner periphery of a front half of the first transmitting member 64. The second spline part 642 includes a plurality of splines (internal teeth) extending in the direction of the rotation axis A3 (i.e. front-rear direction). Correspondingly, a front end portion (a portion adjacent to the rear of the front bearing 411) of the first intermediate shaft 41 is configured as a large-diameter part. The spline part 416 is provided on an outer periphery of the large-diameter part. The spline part 416 includes a plurality of splines (external teeth) that are always engaged (meshed) with the second spline part 642.

With such a structure, when the first spline part 641 is placed in a position (hereinafter referred to as an engagement position) where it is engaged with the spline part 631 of the intervening member 63 in the front-rear direction, as shown by solid lines in FIG. 5, the first transmitting member 64 is rotatable together with the intervening member 63 and the rotary body 611, and thus the first transmitting member 64 is capable of transmitting power from the first intermediate shaft 41 to the intervening member 63. On the other hand, when the first spline part 641 is placed in a position (hereinafter referred to as a spaced apart position) where it is spaced apart (separated) from (incapable of being engaged with) the spline part 631, as shown by dotted lines in FIG. 5, the first transmitting member 64 disables (interrupts, disconnects) power transmission from the first intermediate shaft 41 to the motion-converting member 61.

As described above, in this embodiment, the first transmitting member 64 and the intervening member 63 function as a first clutch mechanism 62 that transmits power for the hammering operation or interrupts this power transmission. In this embodiment, the first transmitting member 64 is connected to a mode-changing mechanism 80 (see FIG. 6). The first transmitting member 64 is movable between the engagement position and the spaced apart position in response to manual operation (rotation) of a mode-changing dial (action mode changing knob) 800 (see FIGS. 2 and 4). Thus, the first clutch mechanism 62 is switchable between a power-transmitting state and a power-interrupting state, in response to manual operation of the mode-changing dial 800. The mode-changing mechanism 80 will be described in detail below.

Figure 4:
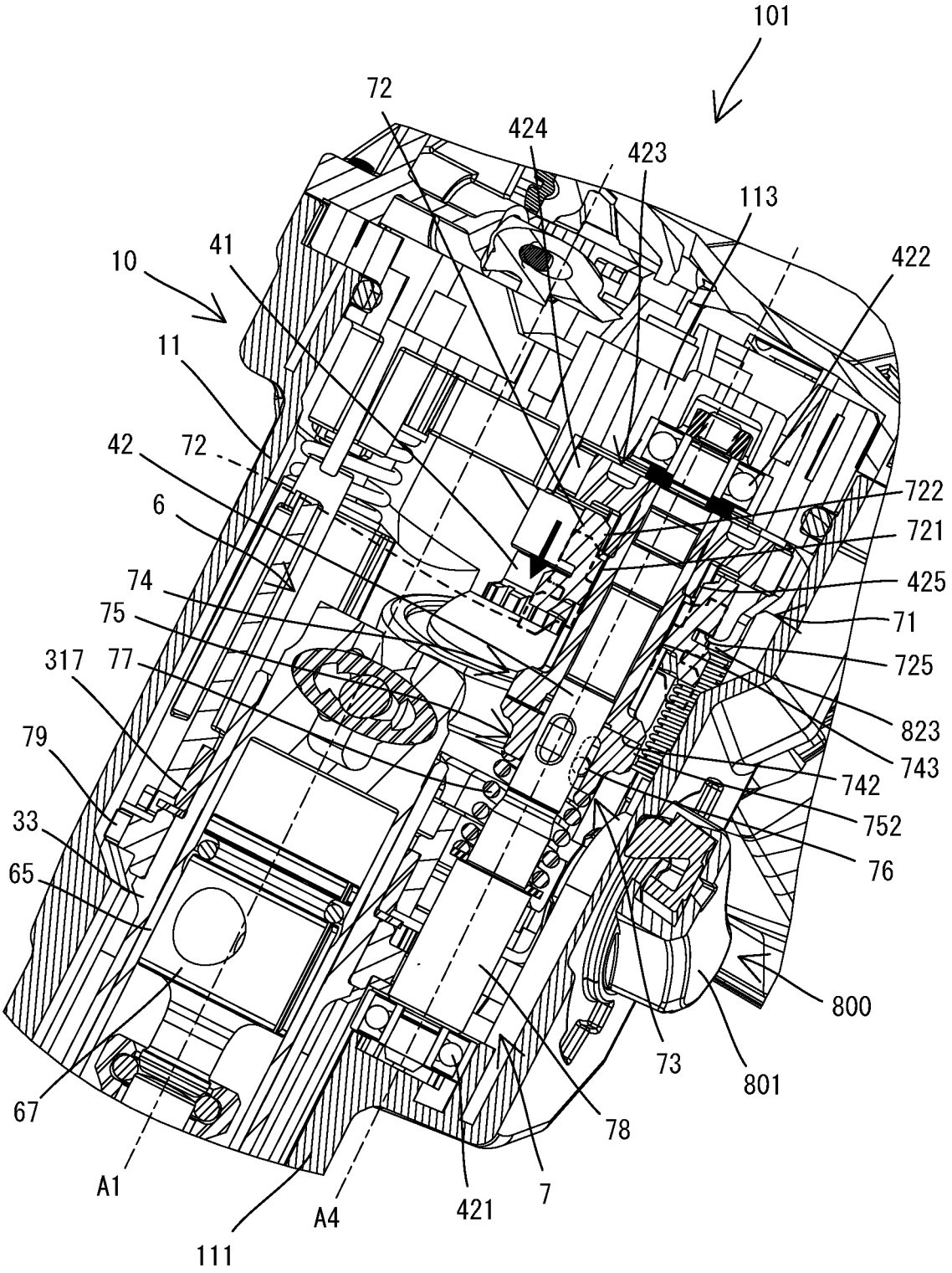
FIG. 4 is a sectional view taken along line IV-IV in FIG. 2.

The rotation-transmitting mechanism 7 is a mechanism for performing the drilling operation. The rotation-transmitting mechanism 7 is configured to transmit rotation of the second intermediate shaft 42 to the spindle 31 and thereby rotationally drive the tool accessory 91 around the driving axis A1. As shown in FIG. 4, in this embodiment, the rotation-transmitting mechanism 7 includes a driving gear 78 and a driven gear 79. The driving gear 78 is fixed to a front end portion (a portion adjacent to the rear of the front bearing 421) of the second intermediate shaft 42. The driven gear 79 is fixed to an outer periphery of the cylinder 33 of the spindle 31 and meshes with the driving gear 78. The driving gear 78 and the driven gear 79 form a speed-reducing (torque-increasing) gear mechanism. The spindle 31 is rotated together with the driven gear 79, while the driving gear 78 rotates together with the second intermediate shaft 42. In this manner, the drilling operation is performed in which the tool accessory 91 held by the tool holder 32 is rotationally driven around the driving axis A1.

As described above, in this embodiment, rotation of the driven gear 424, which is rotated by the first intermediate shaft 41, is transmitted to the second intermediate shaft 42 via the second transmitting member 72 and the torque limiter 73. The torque limiter 73 and the second transmitting member 72 are now described in this order.

As shown in FIGS. 3 and 4, the torque limiter 73 is disposed on the second intermediate shaft 42. The torque limiter 73 is a safety clutch mechanism that is configured to interrupt power transmission when torque acting on the second intermediate shaft 42 exceeds a threshold. In this embodiment, the torque limiter 73 includes a drive-side member 74, a driven-side member 75, balls 76 and a biasing spring 77.

The drive-side member 74 is a circular cylindrical member. The drive-side member 74 is rotatably supported by a rear half of the second intermediate shaft 42. The driven gear 424 is rotatably supported by a rear end portion of the drive-side member 74. Therefore, the drive-side member 74 is rotatable around the rotation axis A4 relative to the second intermediate shaft 42 and the driven gear 424.

The drive-side member 74 includes cam recesses 742 (see FIG. 4) and a spline part 743. The cam recesses 742 are formed on a front end of the drive-side member 74. Although not shown in detail, the cam recesses 742 each have a cam face inclined in a circumferential direction. The spline part 743 is provided on an outer periphery of the drive-side member 74 behind the cam recesses 742. The spline part 743 includes a plurality of splines (external teeth) extending in a direction of the rotation axis A4 (i.e. front-rear direction).

The driven-side member 75 is a circular cylindrical member. The driven-side member 75 is disposed around the second intermediate shaft 42 in front of the drive-side member 74. On an inner periphery of the driven-side member 75, a plurality of grooves are arranged in (around) a circumferential direction. The grooves each extend in the rotation axis A4 direction (i.e. front-rear direction). Further, on an outer periphery of the second intermediate shaft 42, a plurality of grooves are arranged in (around) a circumferential direction. The grooves each extend in the direction of the rotation axis A4 (i.e. front-rear direction). The balls 76 are respectively accommodated within tracks defined by the corresponding grooves, so as to be rollable along the respective tracks that each extend in the front-rear direction, i.e. in parallel to the driving axis A1. Thus, the driven-side member 75 is engaged with the second intermediate shaft 42 via the balls 76 in a radial direction and the circumferential direction, and is rotatable together with the second intermediate shaft 42. Further, the driven-side member 75 is movable in the front-rear direction relative to the second intermediate shaft 42 within a range in which the balls 76 roll within the tracks.

The driven-side member 75 has cam projections 752 (see FIG. 4) provided on its rear end. Although not shown in detail, the cam projections 752 are shaped to substantially conform to the cam recesses 742 of the drive-side member 74. The cam projections 752 each have a cam face inclined in the circumferential direction of the driven-side member 75. The biasing spring 77 is a compression coil spring. The biasing spring 77 is disposed in a compressed state between the driving gear 78 and the driven-side member 75. Therefore, the biasing spring 77 always biases the driven-side member 75 in a direction toward the drive-side member 74 (i.e. rearward), that is, in a direction that causes the cam projections 752 to respectively engage with the cam recesses 742. When the cam projections 752 are engaged with the cam recesses 742, torque is transmitted from the drive-side member 74 to the driven-side member 75 and thus the second intermediate shaft 42 is rotated. Further, the drive-side member 74 and the gear member 423 are biased rearward via the driven-side member 75 and are held in their rearmost positions relative to the second intermediate shaft 42.

Although not shown in detail, when a load exceeding the threshold is applied to the second intermediate shaft 42 via the tool holder 32 (the spindle 31) due to jamming or binding of the tool accessory 91 or other causes, the cam projections 752 disengage from the cam recesses 742. More specifically, owing to the interaction of the cam faces (inclined surface) of the cam projections 752 and the cam recesses 742, the cam projections 752 disengage from the cam recesses 742, against the biasing force of the biasing spring 77, and abut on a front end surface of the drive-side member 74. Thus, the driven-side member 75 moves in a direction away from the drive-side member 74 (i.e. forward). At this time, the driven-side member 75 can smoothly move forward, while being guided by the balls 76 that roll between (in the tracks defined by) the driven-side member 75 and the second intermediate shaft 42. As a result, torque transmission from the drive-side member 74 to the driven-side member 75 is interrupted and thus rotation of the second intermediate shaft 42 is interrupted.

As shown in FIGS. 3 and 4, the second transmitting member 72 is disposed on (around, coaxially with) the second intermediate shaft 42. The second transmitting member 72 is configured to be rotatable together with the drive-side member 74 of the torque limiter 73 and to be movable in the rotation axis A4 direction (i.e. front-rear direction) relative to the drive-side member 74 and the gear member 423.

More specifically, the second transmitting member 72 is a generally circular cylindrical member. The second transmitting member 72 is disposed around the drive-side member 74. A first spline part 721 and a second spline part 722 are provided on an inner periphery of the second transmitting member 72. The first spline part 721 is provided on a front half of the second transmitting member 72. The first spline part 721 includes a plurality of splines (internal teeth) that are always engaged (meshed) with the spline part 743 of the drive-side member 74. The second spline part 722 is provided on a rear end portion of the second transmitting member 72. The second spline part 722 includes a plurality of splines (internal teeth) configured to be engaged (meshed) with the spline part 425 of the gear member 423.

With such a structure, when the second spline part 722 is placed in a position (hereinafter referred to as an engagement position) where it is engaged with the spline part 425 of the gear member 423 in the front-rear direction, as shown by solid lines in FIG. 4, the second transmitting member 72 is rotatable together with the gear member 423. Therefore, the drive-side member 74, which is spline-engaged with the second transmitting member 72, is also rotatable together with the gear member 423. Thus, in the engagement position, the second transmitting member 72 transmits power from the gear member 423 to the second intermediate shaft 42 via the torque limiter 73. On the other hand, when the second spline part 722 is placed in a position (hereinafter referred to as a spaced apart position) where it is spaced apart (separated) from (incapable of being engaged with) the spline part 425, as shown by dotted lines in FIG. 4, the second transmitting member 72 disables (interrupts, disconnects) power transmission from the gear member 423 to the second intermediate shaft 42.

As described above, in this embodiment, the second transmitting member 72 and the gear member 423 function as a second clutch mechanism 71 that transmits power for the drilling operation or interrupts this power transmission. In this embodiment, like the first transmitting member 64, the second transmitting member 72 is connected to the mode-changing mechanism 80 (see FIG. 6), and is moved between the engagement position and the spaced apart position in response to manual operation of the mode-changing dial 800 (see FIG. 2). Thus, like the first clutch mechanism 62, the second clutch mechanism 71 is also switched between the power-transmitting state and the power-interrupting state in response to manual operation of the mode-changing dial 800.

The mode-changing dial 800 and the mode-changing mechanism 80 are now described.

Figure 6:
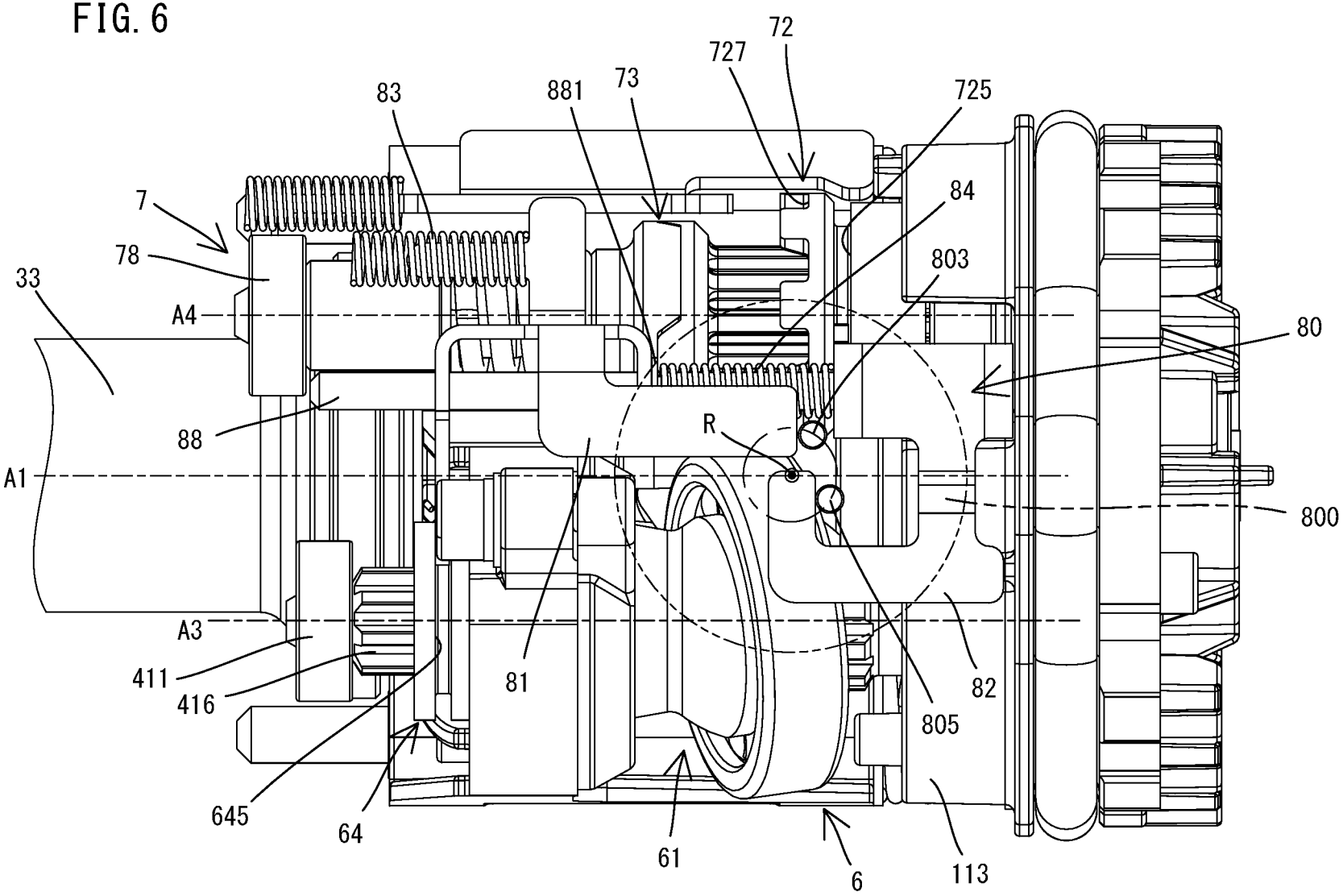
FIG. 6 is an explanatory drawing for illustrating a mode-changing mechanism, wherein a hammer-drill mode has been selected, showing internal structures of a driving-mechanism-housing part as viewed in a direction of a pivot axis of a mode-changing dial.
Figure 7:
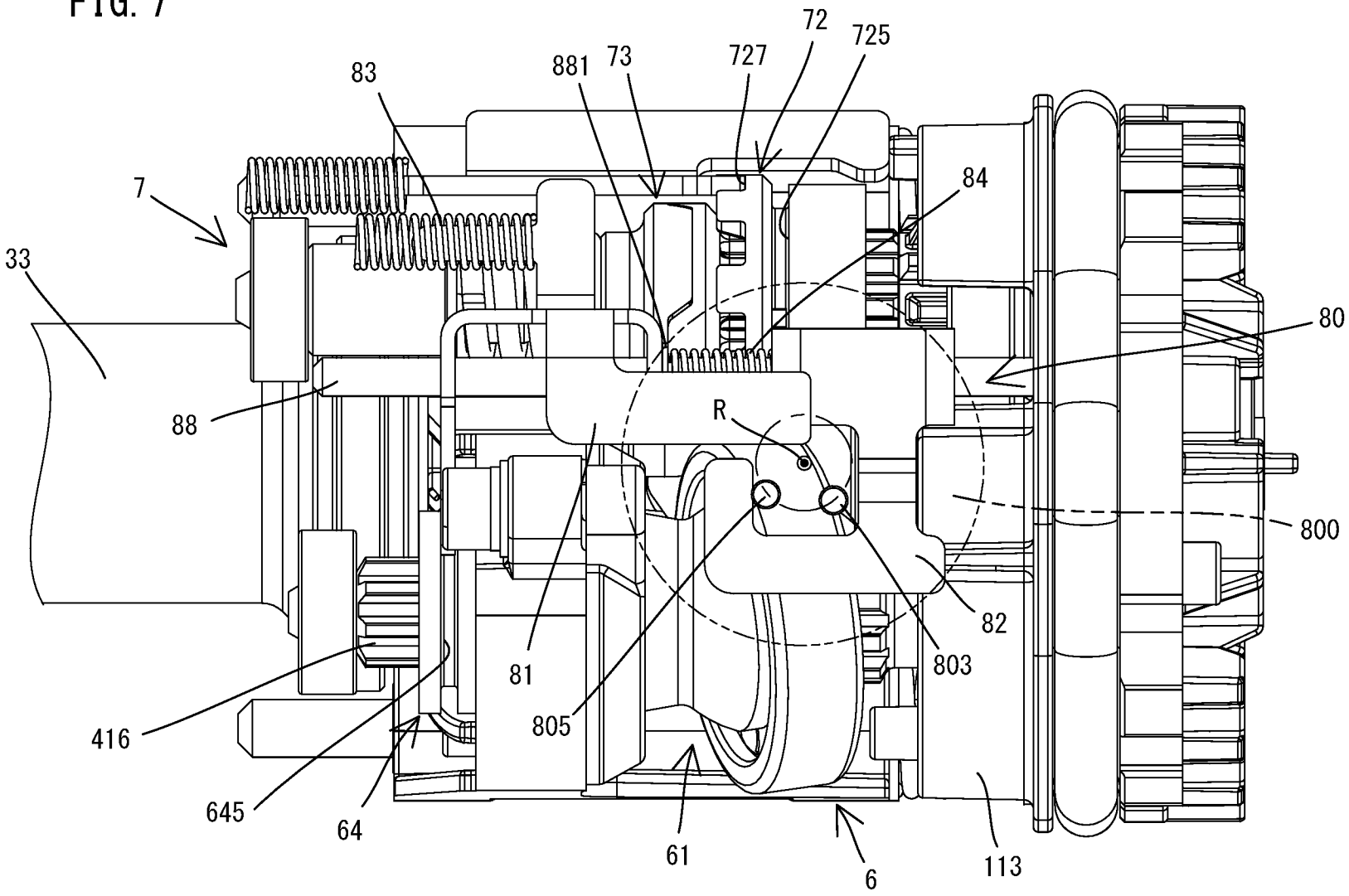
FIG. 7 is an explanatory drawing for illustrating the mode-changing mechanism similar to FIG. 6, wherein a hammer mode has been selected.
Figure 8:
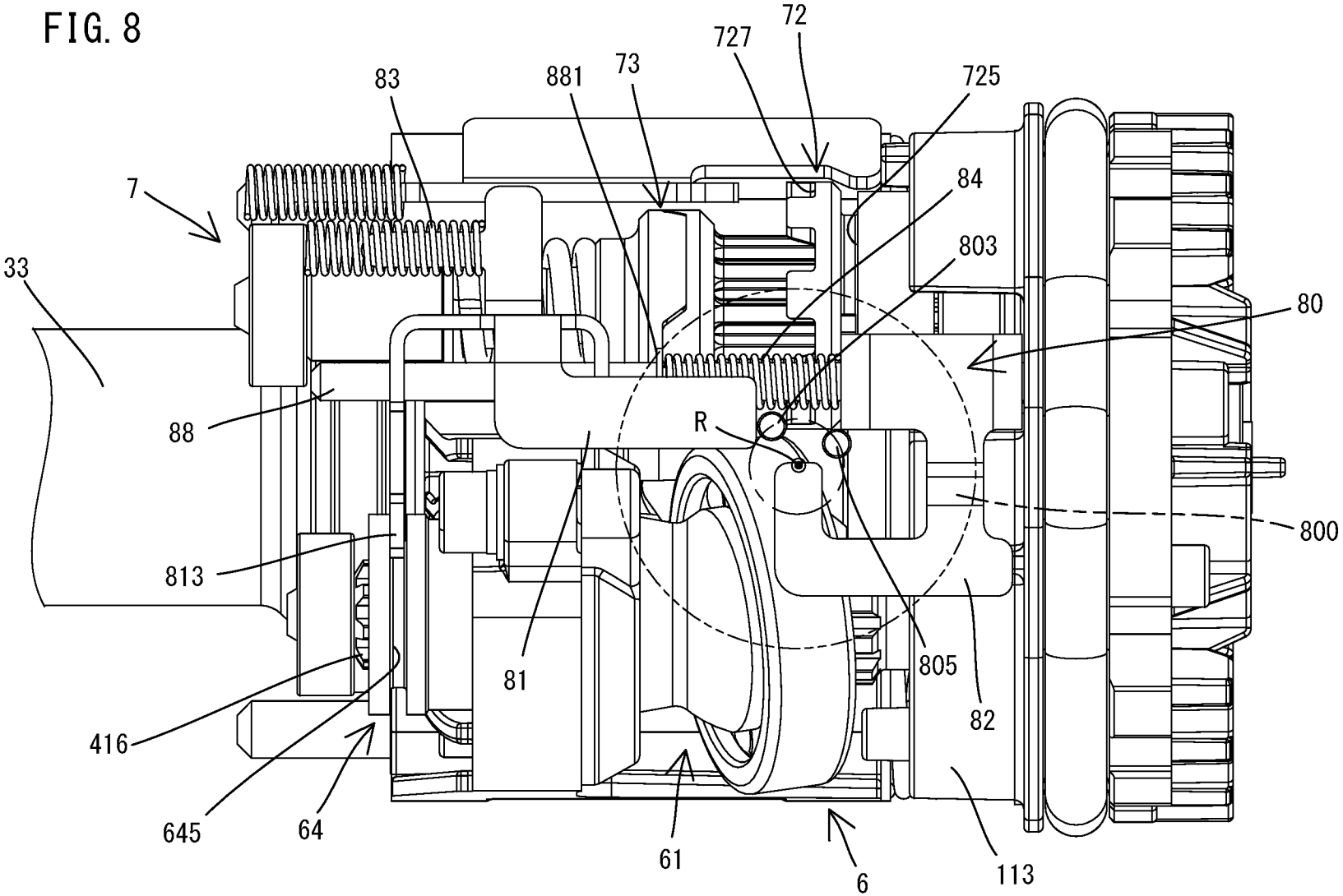
FIG. 8 is an explanatory drawing for illustrating the mode-changing mechanism similar to FIG. 6, wherein a drill mode has been selected.

As shown in FIGS. 6 to 8, the mode-changing mechanism 80 is configured to change the action mode of the rotary hammer 101 in accordance with (in response to) movement (rotation) of the mode-changing dial 800. In this embodiment, the rotary hammer 101 has three action modes, namely, a hammer-drill mode (rotation with hammering), a hammer mode (hammering only) and a drill mode (rotation only). In the hammer-drill mode, the striking mechanism 6 and the rotation-transmitting mechanism 7 are both driven, so that the hammering operation and the drilling operation are both performed, i.e. the tool accessory 91 is simultaneously rotated and axially hammered. In the hammer mode, power transmission for the drilling operation is interrupted by the second clutch mechanism 71 and only the striking mechanism 6 is driven, so that only the hammering operation is performed, i.e. the tool accessory 91 is only hammered (without rotation). In the drill mode, power transmission for the hammering operation is interrupted by the first clutch mechanism 62 and only the rotation-transmitting mechanism 7 is driven, so that only the drilling operation is performed, i.e. the tool accessory 91 is only rotated (without hammering).

As shown in FIGS. 2, 4 and 6, the mode-changing dial 800 is provided on a left side portion of the body housing 10 (specifically, of the driving-mechanism-housing part 11) so that the mode-changing dial 800 can be externally operated (manipulated) by a user. The mode-changing dial 800 includes a disc-like operation part 801 having a knob, a first pin 803 and a second pin 805. The first pin 803 and the second pin 805 protrude from the operation part 801.

The operation part 801 is held by the body housing 10 so as to be rotatable around a pivot axis R (see FIG. 6). A portion of the operation part 801 is exposed to the outside through an opening formed in a left wall of the body housing 10 (of the driving-mechanism-housing part 11) so as to be turnable by the user. It is noted that three rotational positions respectively corresponding to the hammer-drill mode, the hammer mode and the drill mode are respectively defined on the mode-changing dial 800. The user can set a desired action mode by turning the mode-changing dial 800 to the rotational position that corresponds to the desired action mode. The first and second pins 803 and 805 protrude from an inner surface of the operation part 801 toward the interior of the body housing 100. When the mode-changing dial 800 is turned, the first and second pins 803 and 805 move along (trace) a circumference of a circle centered on the pivot axis R of the operation part 801.

The mode-changing mechanism 80 includes a first switching member 81, a second switching member 82, a first spring 83 and a second spring 84.

The first switching member 81 has a pair of support holes (not shown). The first switching member 81 is supported to be movable in the front-rear direction by a support shaft 88, which is inserted through the support holes of the first switching member 81. The support shaft 88 is fixed to the body housing 10 (specifically, to a support wall 113 fixed inside the driving-mechanism-housing part 11). The support shaft 88 extends in the front-rear direction, in parallel to the first and second intermediate shafts 41 and 42. A retaining ring 881 is fixed to a central portion of the support shaft 88 in an axial direction of the support shaft 88. The first switching member 81 is supported in front of the retaining ring 881. The second switching member 82 has a pair of support holes (not shown). The second switching member 82 is supported to be movable in the front-rear direction by the support shaft 88, which is inserted through the support holes of the second switching member 82. The second switching member 82 is disposed behind the retaining ring 881.

The first and second switching members 81 and 82 are respectively engaged with the first and second transmitting members 64 and 72. More specifically, annular grooves 645 and 725 are formed on (in) the outer peripheries of the first and second transmitting members 64 and 72, respectively. The first switching member 81 is engaged with the first transmitting member 64 via a plate-like first engagement part 813 (see FIG. 8) disposed in the groove 645. Similarly, the second switching member 82 is engaged with the second transmitting member 72 via a plate-like second engagement part 823 (see FIG. 5) disposed in the groove 725. The first transmitting member 64 is rotatable relative to the first switching member 81 in a state in which the first engagement part 813 is engaged with the groove 645. Similarly, the second transmitting member 72 is rotatable relative to the second switching member 82 in a state in which the second engagement part 813 is engaged with the groove 725.

The first spring 83 is a compression coil spring. The first spring 83 is disposed in a compressed state between the driving-mechanism-housing part 11 and the first switching member 81, and always biases the first switching member 81 rearward. Thus, the first transmitting member 64 engaged with the first switching member 81 is also always biased rearward toward the engagement position. The second spring 84 is a compression coil spring. The second spring 84 is disposed in a compressed state between the retaining ring 881 fixed to the support shaft 88 and the second switching member 82, and always biases the second switching member 82 rearward. Thus, the second transmitting member 72 engaged with the second switching member 82 is also always biased rearward toward the engagement position. A rearmost position of the first switching member 81 is a position where the first switching member 81 abuts on the retaining ring 881. A rearmost position of the second switching member 82 is a position where the second switching member 82 abuts on a front surface of the support wall 113.

When the mode-changing dial 800 is set (turned) to the rotational position that corresponds to the hammer-drill mode (hereinafter referred to as the hammer-drill position) shown in FIG. 6, the first pin 803 is positioned adjacent to the rear of the first switching member 81 located in the rearmost position, and the second pin 805 is positioned adjacent to the rear of the second switching member 82 located in the rearmost position. At this time, the first transmitting member 64 is located in the engagement position where the second spline part 642 is engaged with the spline part 631 of the intervening member 63 (see FIG. 5), so that the first clutch mechanism 62 is in the power-transmitting state. Further, the second transmitting member 72 is located in the engagement position where the second spline part 722 is engaged with the spline part 425 of the gear member 423 (see FIG. 4), so that the second clutch mechanism 71 is also in the power-transmitting state.

When the motor 2 is energized, power (rotational motion) is transmitted from the motor shaft 25 to the first intermediate shaft 41 via the driving bevel gear 255 and the driven bevel gear 414. Power is then transmitted from the first intermediate shaft 41 to the striking mechanism 6 via the first clutch mechanism 62, so that the hammering operation is performed. At the same time, power (rotational motion) is transmitted from the first intermediate shaft 41 to the second intermediate shaft 42 via the driving gear 415 and the driven gear 424, and further via the second clutch mechanism 71 and the torque limiter 73. This power is then transmitted from the second intermediate shaft 42 to the spindle 31 via the rotation-transmitting mechanism 7, so that the drilling operation is also performed.

When the mode-changing dial 800 is manually turned from the hammer-drill position shown in FIG. 6 to the rotational position that corresponds to the hammer mode (hereinafter referred to as the hammer position) shown in FIG. 7, the second pin 805 moves in a clockwise direction (when viewed from the left) while abutting the rear side of the second switching member 82 and thereby the second switching member 82 moves forward against the biasing force of the second spring 84. When the mode-changing dial 800 is placed in the hammer position, the second switching member 82 is positioned at its foremost position. At the same time, the movement of the second switching member 82 causes the second transmitting member 72 to move from the engagement position to the spaced apart (disengaged) position (see FIG. 4). Thus, the second clutch mechanism 71 is switched to the power-interrupting state, which may also be called the power disconnection state or the rotation disengagement state.

Furthermore, at the same time, the first pin 803 moves in the clockwise direction (when viewed from the left) without interfering with (contacting) the first and second switching members 81 and 82, and is moved to a position spaced apart (separated) from the first and second switching members 81 and 82. Therefore, during this time, the first switching member 81 and the first transmitting member 64 do not move, and thus the first clutch mechanism 62 remains in the power-transmitting state.

In this state, even when the motor 2 is energized, power (rotational motion) is not transmitted from the motor shaft 25 to the second intermediate shaft 42, so that a drilling operation is not performed. On the other hand, power (rotational motion) is transmitted from the motor shaft 25 to the striking mechanism 6 via the first intermediate shaft 41, so that only the hammering operation is performed.

When the mode-changing dial 800 is manually turned from the hammer-drill position shown in FIG. 6 to the rotational position that corresponds to the drill mode (hereinafter referred to as a drill position) shown in FIG. 8, the first pin 803 moves in a counterclockwise direction (when viewed from the left) around the pivot axis R of the operation part 801 and abuts on the first switching member 81 from the rear, whereby the first pin 803 moves the first switching member 81 forward against the biasing force of the first spring 83. When the mode-changing dial 800 is placed in the drill position, the first switching member 81 is positioned at its foremost position. At the same time, the movement of the first switching member 81 causes the first transmitting member 64 to move from the engagement position to the spaced apart (disengaged) position (see FIG. 5). Thus, the first clutch mechanism 62 is switched to the power-interrupting state.

At the same time, the second pin 805 moves in the counterclockwise direction (when viewed from the left) around the pivot axis R of the operation part 801 without interfering with (contacting) the first and second switching members 81 and 82 and is placed in (at) a position adjacent to the second switching member 82. Therefore, during this time, the second switching member 82 and the second transmitting member 72 do not move, and thus the second clutch mechanism 71 remains in the power-transmitting state.

In this state, even when the motor 2 is energized, power (rotational motion) is not transmitted from the first intermediate shaft 41 to the motion-converting member 61, so that a hammering operation is not performed. On the other hand, power (rotational motion) is transmitted from the motor shaft 25 to the rotation-transmitting mechanism 7 via the second intermediate shaft 42, so that only the drilling operation is performed.

As described above, in the rotary hammer 101 of this embodiment, the spindle 31, the first intermediate shaft 41 for the striking mechanism 6 that performs the hammering operation, and the second intermediate shaft 42 for the rotation-transmitting mechanism 7 that performs the drilling operation extend in parallel to each other. The motor shaft 25 extends in the direction that intersects the spindle 31. Rotation of the motor shaft 25 is first transmitted to the first intermediate shaft 41 via the driving bevel gear 255 and the driven bevel gear 414, and is then further transmitted to the second intermediate shaft 42 via the driving gear 415 and the driven gear 424. Thus, the spindle 31 is not located on (in) a power transmission path between the first intermediate shaft 41 and the second intermediate shaft 42. Therefore, unlike an embodiment in which rotation is transmitted from the second intermediate shaft 42 to the first intermediate shaft 41 via the spindle 31, a reduction and an increase of the rotation speed is not required. As a result, efficient power transmission can be realized.

Further, the hammering operation tends to cause a larger load than the drilling operation. Therefore, this embodiment employs a structure in which torque is directly transmitted from the motor shaft 25 to the first intermediate shaft 41, which is subjected to a larger load than the second intermediate shaft 42.

On the first intermediate shaft 41, the driven bevel gear 414 is disposed adjacent to (in abutment with) the front of the bearing 412, and the driving gear 415 is disposed between the driven bevel gear 414 and the motion-converting member 61. In other words, the driven bevel gear 414 and the driving gear 415 are disposed in the vicinity of the bearing 412 that supports the first intermediate shaft 41. Owing to this arrangement, a section (segment) on which the driven bevel gear 414 and the driving gear 415 are disposed can be reduced or minimized in the front-rear direction. Further, the section of the first intermediate shaft 41 in the vicinity of the bearing is less prone to deflect (bend). Therefore, owing to the concentrated (compact) arrangement of the above-described various gears on this section (segment), engagement between the driving bevel gear 255 and the driven bevel gear 414 and engagement between the driving gear 415 and the driven gear 424 can be accurately maintained.

Further, the first intermediate shaft 41 is required to be a certain minimum length because the motion-converting member 61 is mounted on (around) the first intermediate shaft 41. On the other hand, the driving gear 78 that is mounted onto the second intermediate shaft 42 is not required to be so long. In this embodiment, as described above, the position of the driven gear 424 on the second intermediate shaft 42 is determined by the position of the driving gear 415, which is disposed in the vicinity of the rear bearing 412. As a result, there is abundant space in front of the driven gear 424 on the second intermediate shaft 42. Therefore, the torque limiter 73 is rationally arranged, utilized this space. The torque transmitted by the second intermediate shaft 42 is less than the torque on the spindle 31, which serves as the final output shaft. Therefore, the torque limiter 73 can be smaller and lighter in the present embodiment than in an embodiment in which a torque limiter is mounted on the spindle 31.

Further, during operation of the torque limiter 73 of this embodiment, the rolling balls 76 can guide movement of the driven-side member 75 in the direction of the rotation axis A4. This structure can reduce friction between the driven-side member 75 and the second intermediate shaft 42, and thus stabilize the operating (output) torque.

In this embodiment, the driving axis A1, the rotation axis A2 of the motor shaft 25 and the rotation axis A3 of the first intermediate shaft 41 all extend in (coincide with) the same reference plane P. Further, the rotation axis A4 of the second intermediate shaft 42 is located on the left side of the reference plane P. Therefore, the center of gravity of the rotary hammer 101 may be disposed (offset) to the left of the reference plane P. However, because there are more right-handed users than left-handed users, it is believed that right-handed users can easily cope with the deviation (offset) of the center of gravity by holding an auxiliary handle, which is mounted on the barrel part 111, with the left hand. Therefore, it is appropriate that the rotation axis A4 of the second intermediate shaft 42 is located on the left side of the reference plane P, rather than on the right side.

Further, in this embodiment, the first clutch mechanism 62 and the second clutch mechanism 71 are respectively provided on the first intermediate shaft 41 and the second intermediate shaft 42. Therefore, power for the hammering operation and power for the drilling operation can be separately (independently) interrupted as needed. Further, both the first clutch mechanism 62 and the second clutch mechanism 71 can be switched between the power-transmitting state and the power-interrupting state, in response to manual operation of the same operation member (i.e. the mode-changing dial 800). Therefore, a user can cause the first clutch mechanism 62 and the second clutch mechanism 71 to operate, by simply operating (turning) the mode-changing dial 800 to change the action mode, depending on the desired processing operation. Particularly, in this embodiment, a free space below the second intermediate shaft 42 is utilized to rationally arrange the mode-changing dial 800 and the mode-changing mechanism 80.

Correspondences between the features of the above-described embodiment and the features of the disclosure are as follows. The features of the above-described embodiment are merely exemplary and do not limit the features of the present invention. The rotary hammer 101 is an example of the "power tool". The spindle 31 is an example of the "final output shaft". The driving axis A1 is an example of the "driving axis". The motor 2 and the motor shaft 25 are examples of the "motor" and the "motor shaft", respectively. The first intermediate shaft 41 is an example of the "first intermediate shaft". The striking mechanism 6 is an example of the "first driving mechanism". The second intermediate shaft 42 is an example of the "second intermediate shaft". The rotation-transmitting mechanism 7 is an example of the "second driving mechanism". The driving bevel gear 255 and the driven bevel gear 414 are an example of the "pair of bevel gears". The driving gear 415 and the driven gear 424 are an example of the "pair of gears".

The motion-converting member 61 is an example of the "motion-converting member". The bearing 412 is an example of the "bearing". The driven bevel gear 414 is an example of the "one of the bevel gears". The torque limiter 43 is an example of the "torque limiter". The first clutch mechanism 62 and the second clutch mechanism 71 are examples of the "first clutch mechanism" and the "second clutch mechanism", respectively. The mode-changing dial 800 (the operation part 801) is an example of the "operation member". The drive-side member 74, the driven-side member 75 and the ball 76 are examples of the "drive side cam", the "driven side cam" and the "ball", respectively. The biasing spring 77 is an example of the "biasing member". The mode-changing mechanism 80, the first switching member 81 and the second switching member 82 are examples of the "switching mechanism", the "first switching member" and the "second switching member", respectively. The first pin 803 and the second pin 805 are examples of the "first abutment part" and the "second abutment part", respectively. The support shaft 88 is an example of the "support member".

The above-described embodiment is merely an exemplary embodiment of the disclosure, and a power tool according to the present disclosure is not limited to the rotary hammer 101 of the above-described embodiment. For example, the following modifications may be made. One or more of these modifications may be adopted in combination with the rotary hammer 101 of the above-described embodiment or the claimed features.

The rotary hammer 101 may be configured to be operated using power supplied from an external AC power source, instead from a rechargeable battery. In such an embodiment, a power cable (power cord) that is connectable to the external AC power source may be provided, in place of the battery-mounting part 173. Further, the motor 2 may be an AC motor, instead of a DC motor. The motor 2 may be a motor with a brush, instead of a brushless motor.

The structures (such as shapes, components and materials) of the body housing 10 and the handle 15 may be appropriately changed. For example, the motor-housing part 12 may protrude downward in a direction that is orthogonal to the driving axis A1 from the rear end portion of the driving-mechanism-housing part 11. In such an embodiment, the motor 2 may be arranged such that the rotation axis A2 of the motor shaft 25 extends orthogonally to the rotation axis A3 of the first intermediate shaft 41.

Further, the body housing 10 may have a vibration-isolating structure that is different from that of the above-described embodiment. For example, both end portions of the handle 15 may be connected to the body housing 10 so that both ends are elastically movable relative to the body housing 10. Alternatively, the body housing 10 may include an inner housing that houses the driving mechanism 5, and an outer housing that includes a grip part configured to be held by a user and is elastically connected to the inner housing so as to be movable relative to the inner housing. Further, the spindle 31 and the striking mechanism 6 may be supported by a support body within the body housing 10 such that the spindle 31, the striking mechanism 6 and the support body are integrally movable in the front-rear direction relative to the body housing 10. Such a vibration-isolating structure is disclosed, for example, in US Patent Publication No. 2017/0106517, which is hereby incorporated by reference.

The positions of the first intermediate shaft 41 (the rotation axis A3) and the second intermediate shaft 42 (the rotation axis A4) relative to the motor shaft 25 (the rotation axis A2), and the positions of the first intermediate shaft 41 (the rotation axis A3) and the second intermediate shaft 42 (the rotation axis A4) relative to the spindle 31 (the driving axis A1) are not limited to those of the above-described embodiment.

For example, rotation of the motor shaft 25 may be first transmitted to the second intermediate shaft 42 and then transmitted from the second intermediate shaft 42 to the first intermediate shaft 41. In such an embodiment, it may be preferable that a driven bevel gear is disposed adjacent to the front of the bearing 422 of the second intermediate shaft 42 to mesh with the driving bevel gear 255, and a driving gear is further disposed adjacent to the front of the driven bevel gear. Further, a driven gear may be disposed adjacent to the front of the bearing 412 of the first intermediate shaft 41 to mesh with the driving gear of the second intermediate shaft 42.

The rotation axis A2 of the motor shaft 25 and the rotation axis A3 of the first intermediate shaft 41 (or the rotation axis A4 of the second intermediate shaft 42) need not extend in (coincide with) the same plane. In such a modified embodiment, rotation of the motor shaft 25 may be transmitted to the first intermediate shaft 41 (or to the second intermediate shaft 42), for example, via a pair of hypoid gears. Further, the driving axis A1 need not extend in the same plane as the rotation axis A2 of the motor shaft 25 and/or the rotation axis A3 of the first intermediate shaft 41 (or the rotation axis A4 of the second intermediate shaft 42).

The structures and positions of the first and second clutch mechanisms 62, 71, the torque limiter 73 and the mode-changing mechanism 80 may be appropriately changed.

For example, the intervening member 63 may be omitted, and the first transmitting member 64 of the first clutch mechanism 62 may be movable between a position where it is engaged with the motion-converting member 61 (specifically, with the rotary body 611) and a position where it is spaced apart from the motion-converting member 61. In other words, the first transmitting member 64 may be configured to directly transmit rotation of the first intermediate shaft 41 to the motion-converting member 61 (specifically, to the rotary body 611). Further, the second clutch mechanism 71 may be configured to transmit power and to interrupt the power transmission not between the driven gear 424 and the second intermediate shaft 42, but between the second intermediate shaft 42 and the driving gear 78.

The rotary hammer 101 may be configured to perform only the hammer-drill mode and the hammer mode among the three action modes, i.e. the hammer-drill mode, the hammer mode and the drill mode (i.e. the drill mode may be omitted). In such an embodiment, only the second clutch mechanism 71 may be provided on the second intermediate shaft 42 and the first clutch mechanism 62 may be omitted. Furthermore, the first switching member 81 and the first spring 83 of the mode-changing mechanism 80 may also be omitted.

The driven-side member 75 of the torque limiter 73 and the second intermediate shaft 42 may be spline-engaged with each other, instead of being engaged via the balls 76. Not the driven-side member 75 but the drive-side member 74 may be movable on the second intermediate shaft 42. Further, the torque limiter 73 may be omitted, or may be provided on the spindle 31.

In the mode-changing mechanism 80, the shapes and positions of the first and second switching members 81 and 82, the first and second springs 83 and 84, as well as their manner of movement along with the mode-changing dial 800 may be appropriately changed. For example, the first switching member 81 for switching the first clutch mechanism 62 and the second switching member 82 for switching the second clutch mechanism 71 may be configured to be moved by separate (discrete) operation members, respectively. Further, the operation member that is configured to operate the mode-changing mechanism 80 is not limited to a rotary dial, and may be, for example, a slide lever. The first and second springs 83 and 84 may be other kinds of springs (such as a tensile coil spring or a torsion spring). The first and second switching members 81 and 82 need not necessarily be biased.

Further, in view of the nature of the present disclosure and the above-described embodiment, the following aspects can be provided. Any one of the following aspects can be employed in combination with any one of the rotary hammer 101 of the above-described embodiment, its modifications and the claimed features.

(Aspect 1)

The rotation axis of the motor shaft and a rotation axis of the first intermediate shaft are (extend) in the same plane.

(Aspect 2)

The rotation axis of the second intermediate shaft is located on the left side of the driving axis.

(Aspect 3)

The first driving mechanism includes:

an oscillating member disposed on the first intermediate shaft and configured to oscillate in accordance with (in response to) rotation of the first intermediate shaft, a piston configured to reciprocate along the driving axis in accordance with oscillating movement of the oscillating member, and a striking element configured to linearly move owing to action of an air spring generated by reciprocating movement of the piston and thereby linearly dive the tool accessory.

The motion-converting member 61 (the oscillating member 616), the piston 65 and the striker 67 are examples of the "oscillating member", the "piston" and the "striking element", respectively, in this aspect.

(Aspect 4)

The second driving mechanism is a speed-reducing gear mechanism that includes:

a first rotation-transmitting gear disposed on the second intermediate shaft and configured to rotate together with the second intermediate shaft, and a second rotation-transmitting gear provided on an outer periphery of the final output shaft and meshing with the first rotation-transmitting gear.

The driving gear 78 and the driven gear 79 are examples of the "first rotation-transmitting gear" and the "second rotation-transmitting gear", respectively, in this aspect.

This application hereby incorporates by reference the entire disclosure of U.S. application Ser. No. 17/072,462, and the entire disclosure of U.S. application Ser. No. 17/072,484.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved power tools having a hammer mechanism.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

DESCRIPTION OF THE REFERENCE NUMERALS

101: rotary hammer, 2: motor, 5: driving mechanism, 6: striking mechanism, 7: rotation-transmitting mechanism, 10: body housing, 11: driving-mechanism-housing part, 12: motor-housing part, 15: handle, 16: grip part, 17: controller-housing part, 20: body, 25: motor shaft, 31: spindle, 32: tool holder, 33: cylinder, 41: first intermediate shaft, 42: second intermediate shaft, 61: motion-converting member, 62: first clutch mechanism, 63: intervening member, 64: first transmitting member, 65: piston, 67: striker, 68: impact bolt, 71: second clutch mechanism, 72: second transmitting member, 73: torque limiter, 74: drive-side member, 75: driven-side member, 76: ball, 77: biasing spring, 78: driving gear, 79:

driven gear, 80: mode-changing mechanism, 81: first switching member, 82: second switching member, 83: first spring, 84: second spring, 88: support shaft, 91: tool accessory, 111: barrel part, 113: support wall, 161: trigger, 162: switch, 171: controller, 173: battery-mounting part, 251: bearing, 255: driving bevel gear, 316: bearing, 411: bearing, 412: bearing, 414: driven bevel gear, 415: driving gear, 416: spline part, 421: bearing, 422: bearing, 423: gear member, 424: driven gear, 425: spline part, 611: rotary body, 614: bearing, 616: oscillating member, 617: arm part, 631: spline part, 641: first spline part, 642: second spline part, 645: groove, 721: first spline part, 722: second spline part, 725: groove, 742: cam recess, 743: spline part, 752: cam projection, 800: mode-changing dial, 801: operation part, 803: first pin, 805: second pin, 813: first engagement part, 823: second engagement part, 881: retaining ring, A1: driving axis, A2: rotation axis, A3: rotation axis, A4: rotation axis, P: reference plane, R: pivot axis

What is claimed is:

1. A power tool, comprising:

a final output shaft configured to removably hold a tool accessory and to be rotatable around a driving axis;

a motor having a motor shaft extending in a direction intersecting the driving axis;

a first intermediate shaft extending in parallel to the driving axis;

a first driving mechanism including a motion-converting mechanism disposed on and/or around the first intermediate shaft and configured to convert rotation of the first intermediate shaft into linear reciprocating motion to hammer the tool accessory along the driving axis;

a second intermediate shaft extending in parallel to the driving axis; and a second driving mechanism configured to transmit rotation of the second intermediate shaft to the final output shaft to rotationally drive the tool accessory around the driving axis, wherein:

the motor shaft is configured to rotate the first intermediate shaft via first and second bevel gears, the first bevel gear being disposed on the first intermediate shaft adjacent to a first bearing that rotatably supports a first end portion of the first intermediate shaft, and the first intermediate shaft is configured to rotate the second intermediate shaft via first and second gears, the first gear being disposed on the first intermediate shaft between the first bevel gear and the motion-converting mechanism.

2. The power tool as defined in claim 1, further comprising a torque limiter disposed on and/or around the second intermediate shaft and configured to interrupt transmission of power in response to torque acting on the second intermediate shaft exceeding a threshold.

3. The power tool as defined in claim 2, wherein the torque limiter includes:

a drive-side cam;

a driven-side cam configured to engage with the drive-side cam; and a ball rollably disposed within a track extending in an axial direction of the second intermediate shaft between an inner periphery of one of the drive-side cam and the driven-side cam and an outer periphery of the second intermediate shaft, wherein the one of the drive-side cam and the driven-side cam is configured to, in response to the torque acting on the second intermediate shaft exceeding the threshold, move in the axial direction away from the other of the drive-side cam and the driven-side cam to be disengaged therefrom, while being guided by the ball.

4. The power tool as defined in claim 3, wherein the torque limiter includes a biasing member configured to bias the drive-side cam toward the driven-side cam or vice versa.

5. The power tool as defined in claim 1, wherein a rotation axis of the motor shaft and a rotation axis of the first intermediate shaft define a first plane.

6. The power tool as defined in claim 5, wherein the driving axis also extends in the first plane.

7. The power tool as defined in claim 6, wherein:

an extension direction of the driving axis is defined as a front-rear direction of the power tool, an up-down direction is orthogonal to the driving axis and generally corresponds to an extension direction of the motor shaft, a left-right direction is orthogonal to the front-rear direction and to the up-down direction, in the front-rear direction, the tool accessory is disposed on a front side of the power tool, in the up-down direction, the motor is located on a lower side of the driving axis, and when viewed from a rear side of the power tool in the front-rear direction, a rotation axis of the second intermediate shaft is located leftward of the first plane in the left-right direction.

8. The power tool as defined in claim 1, further comprising:

a first clutch mechanism provided on and/or around the first intermediate shaft and configured to enable and disable power transmission for linearly driving the tool accessory, and a second clutch mechanism provided on and/or around the second intermediate shaft and configured to enable and disable power transmission for rotationally driving the tool accessory.

9. The power tool as defined in claim 8, further comprising:

a manually operable member configured to selectively change an action mode of the power tool, wherein the first and second clutch mechanisms are each configured to be switched between a power-transmitting state and a power-interrupting state in response to manual operation of the manually operable member.

10. The power tool as defined in claim 9, further comprising:

a first switching member configured to move in response to manual operation of the manually operable member and thereby switch the first clutch mechanism between the power-transmitting state and the power-interrupting state, and a second switching member configured to move in response to manual operation of the manually operable member and thereby switch the second clutch mechanism between the power-transmitting state and the power-interrupting state.

11. The power tool as defined in claim 10, wherein the manually operable member includes:

a first contact part configured to come into contact with the first switching member and thereby move the first switching member, and a second contact part configured to come into contact with the second switching member and thereby move the second switching member.

12. The power tool as defined in claim 10, wherein an integral support member supports the first switching member and the second switching member so as to be movable relative to the integral support member.

13. The power tool as defined in claim 1, wherein:

a first portion of the first intermediate shaft extends between the first gear and a second bearing that rotatably supports a second end portion of the first intermediate shaft, a second portion of the second intermediate shaft extends between the second gear and a bearing rotatable supporting a forwardmost end of the second intermediate shaft, and the first portion at least partially overlaps the second portion in a direction perpendicular to the driving axis.

14. The power tool as defined in claim 13, wherein:

the motion-converting mechanism is disposed on and/or around a segment of the first portion of the first intermediate shaft that overlaps the second portion of the second intermediate shaft in the direction perpendicular to the driving axis.

15. The power tool as defined in claim 1, wherein the first gear is disposed between the first bearing and a second bearing that rotatably supports a second end portion of the first intermediate shaft.

16. A power tool, comprising:

a final output shaft configured to removably hold a tool accessory and to be rotatable around a driving axis;

a motor having a motor shaft that extends in a direction intersecting the driving axis;

a first intermediate shaft extending in parallel to the driving axis;

a second intermediate shaft extending in parallel to the driving axis and to the first intermediate shaft;

a motion-converting mechanism configured to convert rotation of the first intermediate shaft into linear reciprocating motion to hammer the tool accessory along the driving axis;

a rotation-transmitting mechanism configured to transmit rotation of the second intermediate shaft to the final output shaft to rotationally drive the tool accessory around the driving axis;

a driving bevel gear disposed on the motor shaft;

a driven bevel gear disposed on the first intermediate shaft adjacent to a bearing that rotatably supports one end portion of the first intermediate shaft, the driven bevel gear meshing with the driving bevel gear disposed on the motor shaft;

a driving gear disposed on the first intermediate shaft between the driven bevel gear and the motion-converting mechanism; and a driven gear disposed on the second intermediate shaft, the driven gear meshing with the driving gear.

17. A power tool, comprising:

a motor having a motor shaft that is rotatable around a rotational axis;

a first intermediate shaft;

a second intermediate shaft extending in parallel to the first intermediate shaft;

an output shaft configured to removably hold a tool accessory, the output shaft having a driving axis that extends in parallel to the first intermediate shaft and to the second intermediate shaft;

a motion-converting mechanism configured to convert rotation of the first intermediate shaft only into linear reciprocating motion and thereby hammer the tool accessory along the driving axis; and a rotation-transmitting mechanism configured to transmit rotation of the second intermediate shaft to the output shaft and thereby only rotationally drive the output shaft around the driving axis;

wherein:

the rotational axis of the motor shaft intersects the driving axis or is skewed with respect to the driving axis;

a pair of first gears operably couples the motor shaft to the first intermediate shaft;

a pair of second gears operably couples the first intermediate shaft to the second intermediate shaft;

a first one of the first gears is disposed on the first intermediate shaft adjacent to a bearing that rotatably supports one end portion of the first intermediate shaft;

a first one of the second gears is disposed on the first intermediate shaft between the first one of the first gears and the motion-converting mechanism; and the first gears are bevel gears.

18. The power tool as defined in claim 17, wherein:

an extension direction of the driving axis is defined as a front-rear direction of the power tool;

a left-right direction is orthogonal to the front-rear direction;

an up-down direction is orthogonal to the left-right direction and to the front-rear direction;

the vertical plane is defined by the extension direction of the driving axis and the up-down direction;

the rotational axis of the motor shaft, a rotational axis of the first intermediate shaft and the driving axis all extend in the vertical plane;

in the front-rear direction, the tool accessory is disposed on a front side of the power tool;

in the up-down direction, the motor is located downward of the driving axis; and when viewed from a rear side of the power tool in the front-rear direction, a rotational axis of the second intermediate shaft is located leftward of the vertical plane in the left-right direction.

19. The power tool as defined in claim 18, further comprising:

a torque limiter disposed on or around the second intermediate shaft and configured to interrupt transmission of power in response to torque acting on the second intermediate shaft exceeding a threshold, wherein the torque limiter includes:

a drive-side cam;

a driven-side cam configured to engage with the drive-side cam;

a ball rollably disposed within a track extending in an axial direction of the second intermediate shaft between an inner periphery of one of the drive-side cam and the driven-side cam and an outer periphery of the second intermediate shaft; and a biasing member urging the drive-side cam toward the driven-side cam or vice versa;

wherein the one of the drive-side cam and the driven-side cam is configured to, in response to the torque acting on the second intermediate shaft exceeding the threshold, move in the axial direction away from the other of the drive-side cam and the driven-side cam to be disengaged therefrom, while being guided by the ball.

20. The power tool as defined in claim 19, further comprising:

a first clutch mechanism provided on and/or around the first intermediate shaft and configured to enable and disable power transmission for linearly driving the tool accessory along the driving axis;

a second clutch mechanism provided on and/or around the second intermediate shaft and configured to enable and disable power transmission for rotationally driving the tool accessory;

a manually operable member configured to selectively change an action mode of the power tool;

a first switching member configured to move in response to manual operation of the manually operable member and thereby switch the first clutch mechanism between a power-transmitting state and a power-interrupting state;

a second switching member configured to move in response to manual operation of the manually operable member and thereby switch the second clutch mechanism between a power-transmitting state and a power-interrupting state; and an integral support member that supports the first switching member and the second switching member so as to be movable relative to the integral support member;

wherein the manually operable member includes:

a first contact part configured to come into contact with the first switching member and thereby move the first switching member; and a second contact part configured to come into contact with the second switching member and thereby move the second switching member.

* * * * *